US011484179B1

(12) United States Patent
Camm

(10) Patent No.: US 11,484,179 B1
(45) Date of Patent: Nov. 1, 2022

(54) DISHWASHER STATUS INDICATOR

(71) Applicant: William Camm, Tarpon Springs, FL (US)

(72) Inventor: William Camm, Tarpon Springs, FL (US)

( * ) Notice: Subject to any disclaimer, the term of this patent is extended or adjusted under 35 U.S.C. 154(b) by 0 days.

(21) Appl. No.: 16/934,090

(22) Filed: Jul. 21, 2020

(51) Int. Cl.
*A47L 15/42* (2006.01)

(52) U.S. Cl.
CPC ..... *A47L 15/4274* (2013.01); *A47L 15/4295* (2013.01); *A47L 2401/06* (2013.01); *A47L 2401/26* (2013.01); *A47L 2501/26* (2013.01)

(58) Field of Classification Search
CPC ..... A47L 15/4293; A47L 15/4295; A47L 15/4297; A47L 15/00–508
See application file for complete search history.

(56) References Cited

U.S. PATENT DOCUMENTS

| | | | | |
|---|---|---|---|---|
| 4,653,423 | A | 3/1987 | Schafer | |
| D345,829 | S | 4/1994 | Mancuso | |
| 5,839,458 | A | 11/1998 | Delcarson | |
| 6,741,183 | B1 * | 5/2004 | Burnett | A47L 15/4257 134/113 |
| 8,771,433 | B2 | 7/2014 | Gray | |
| 9,119,522 | B1 | 9/2015 | Barksdale | |
| 2016/0262594 | A1 | 9/2016 | Chan | |
| 2017/0045871 | A1 * | 2/2017 | Strahle | A47L 15/006 |
| 2018/0110393 | A1 | 4/2018 | Fisher | |

FOREIGN PATENT DOCUMENTS

| | | |
|---|---|---|
| WO | 2008074590 | 6/2008 |

* cited by examiner

*Primary Examiner* — Spencer E. Bell
(74) *Attorney, Agent, or Firm* — Kyle A. Fletcher, Esq.

(57) ABSTRACT

The dishwasher status indicator includes an announcement module, a monitoring module, and a wireless communication link. The wireless communication link exchanges data between the monitoring module and the announcement module. The dishwasher status indicator is for use with a dish washing machine. The dishwasher status indicator monitors the operation of the dish washing machine. The dishwasher status indicator determines and indicates when the contents of the dish washing machine are clean. The monitoring module is placed inside of the dish washing machine. The monitoring module detects the presence of water in the dish washer to determine whether the dish washer has run. The announcement module attaches to the door of the dish washing machine. The announcement module visually and audibly indicates whether the contents of the dish washing machine are clean and dirty.

17 Claims, 5 Drawing Sheets

DISHWASHER STATUS INDICATOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic washing and cleaning including the cleaning of tableware, more specifically, a remote monitoring system of a dishwasher. (A47L15/0063)

SUMMARY OF INVENTION

The dishwasher status indicator comprises an announcement module, a monitoring module, and a wireless communication link. The wireless communication link exchanges data between the monitoring module and the announcement module. The dishwasher status indicator is configured for use with a dish washing machine. The dishwasher status indicator monitors the operation of the dish washing machine. The dishwasher status indicator determines and indicates when the contents of the dish washing machine are clean. The monitoring module is placed inside of the dish washing machine. The monitoring module detects the presence of water in the dish washer to determine whether the dish washer has run. The announcement module attaches to the door of the dish washing machine. The announcement module visually and audibly indicates whether the contents of the dish washing machine are clean and dirty.

These together with additional objects, features and advantages of the dishwasher status indicator will be readily apparent to those of ordinary skill in the art upon reading the following detailed description of the presently preferred, but nonetheless illustrative, embodiments when taken in conjunction with the accompanying drawings.

In this respect, before explaining the current embodiments of the dishwasher status indicator in detail, it is to be understood that the dishwasher status indicator is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dishwasher status indicator.

It is therefore important that the claims be regarded as including such equivalent construction insofar as they do not depart from the spirit and scope of the dishwasher status indicator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
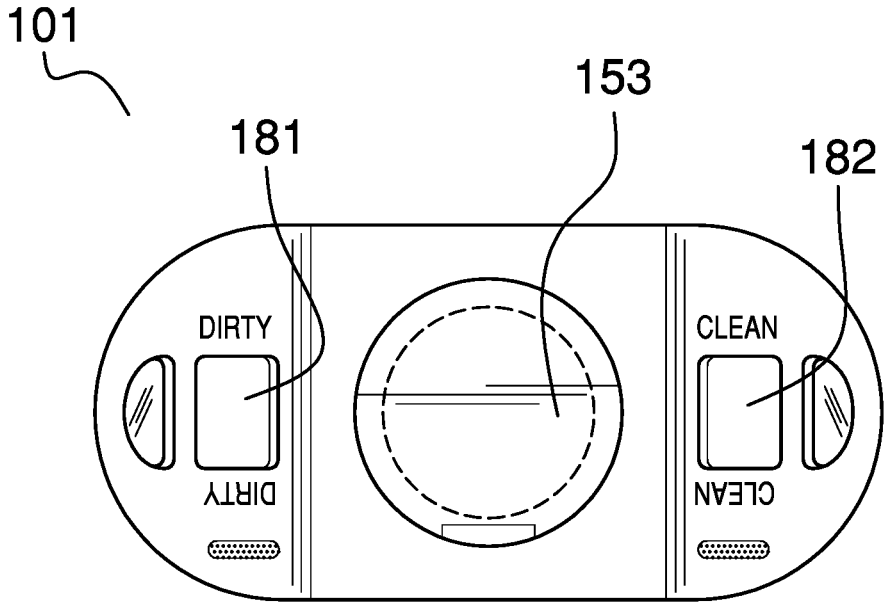
FIG. 1 is a front view of an embodiment of the disclosure.
Figure 2:
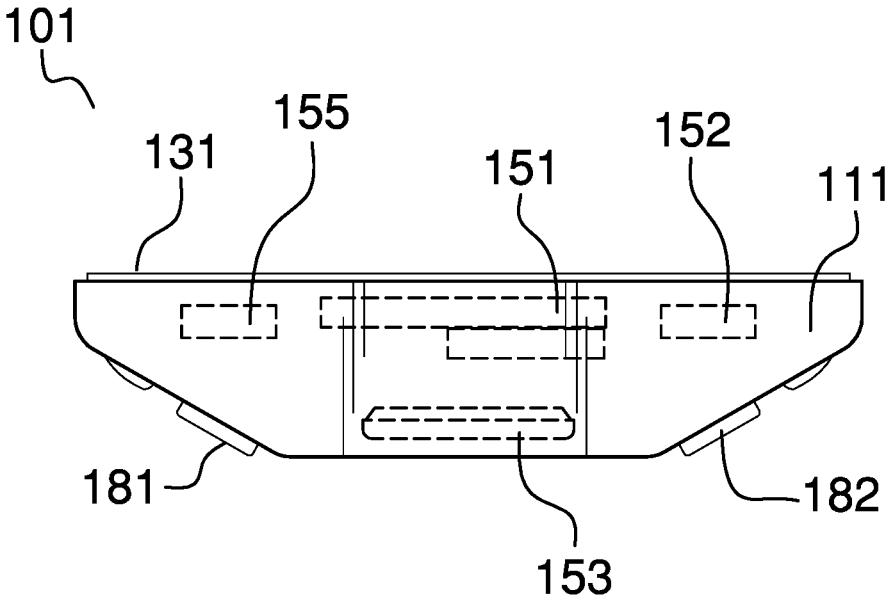
FIG. 2 is a side view of an embodiment of the disclosure.
Figure 3:
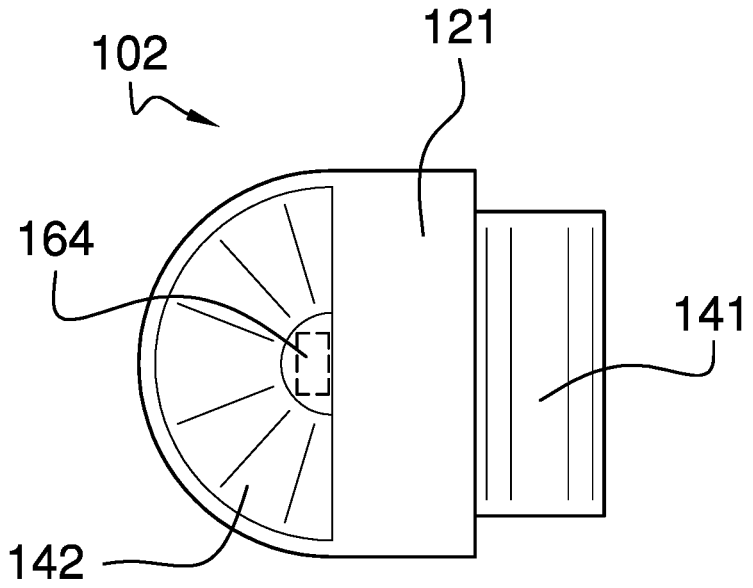
FIG. 3 is a top view of an embodiment of the disclosure.
Figure 4:
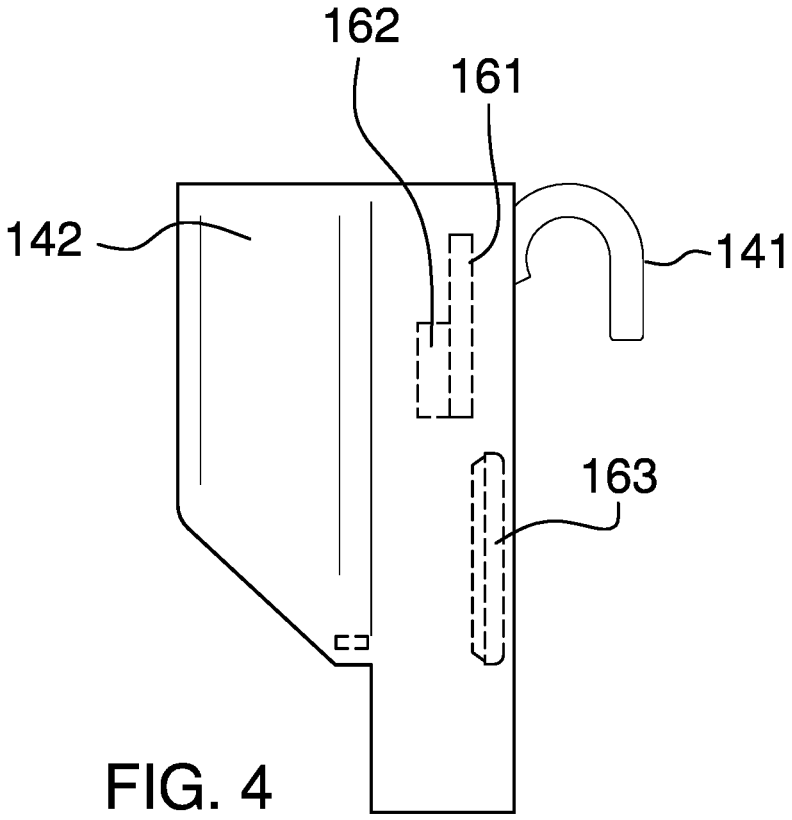
FIG. 4 is a side view of an embodiment of the disclosure.
Figure 5:
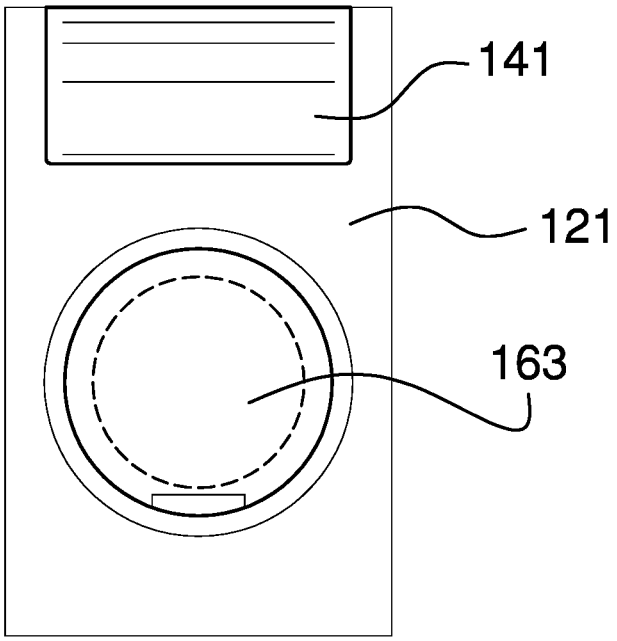
FIG. 5 is a rear view of an embodiment of the disclosure.
Figure 6:
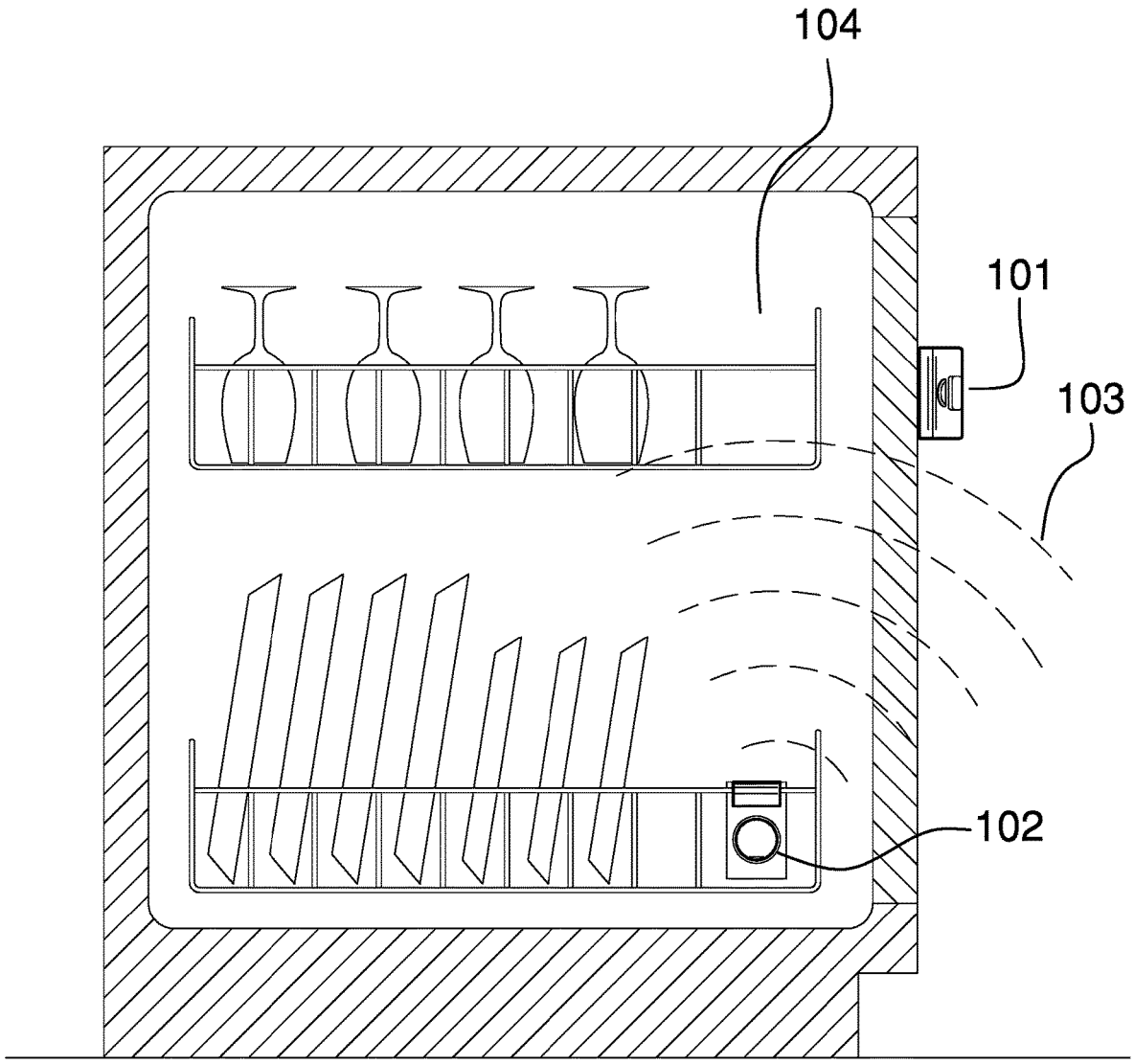
FIG. 6 is an in-use view of an embodiment of the disclosure.
Figure 7:
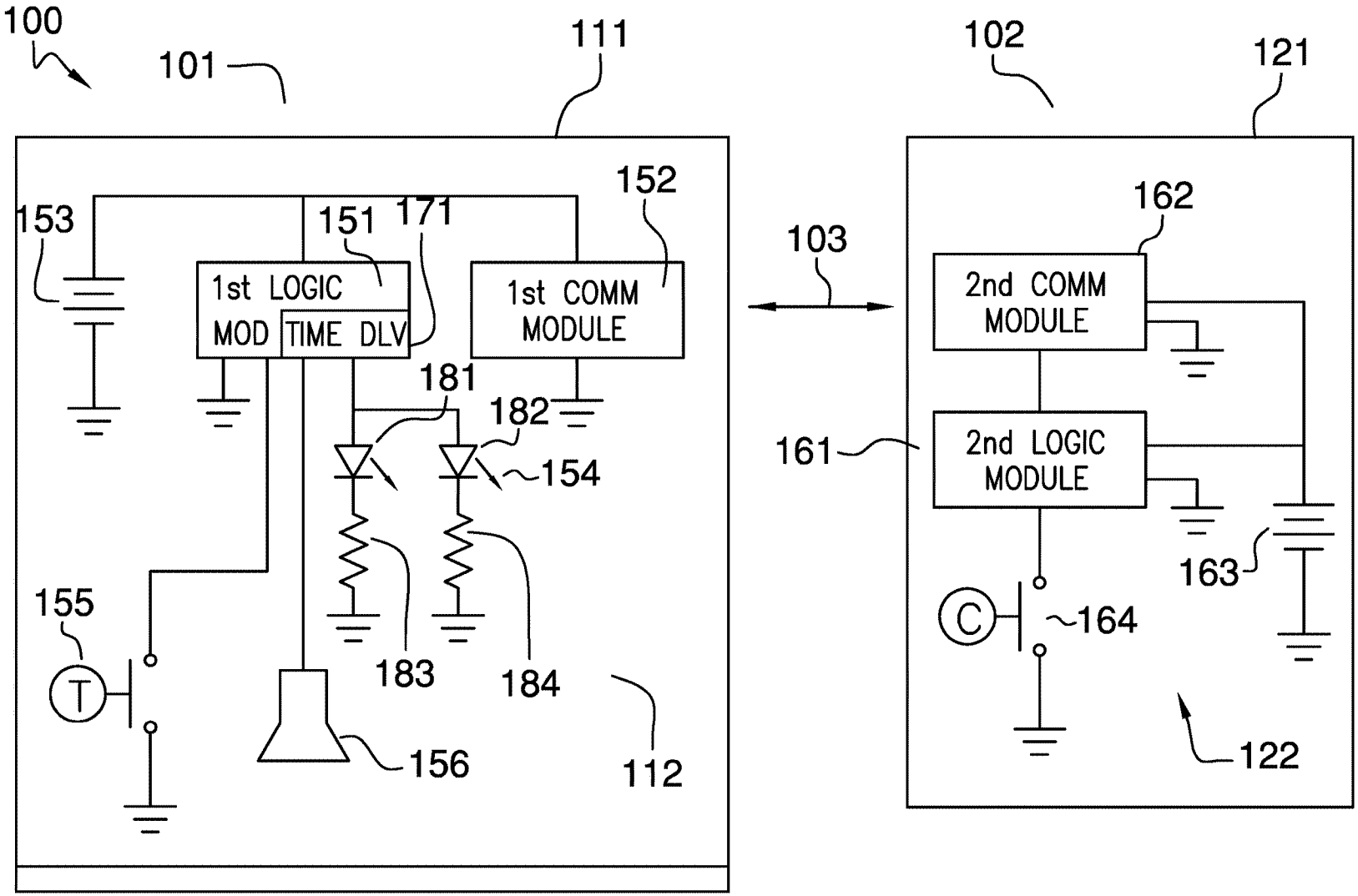
FIG. 7 is a schematic view of an embodiment of the disclosure.

Detailed reference will now be made to one or more potential embodiments of the disclosure, which are illustrated in FIGS. 1 through 7.

The dishwasher status indicator 100 (hereinafter invention) comprises an announcement module 101, a monitoring module 102, and a wireless communication link 103. The wireless communication link 103 exchanges data between the monitoring module 102 and the announcement module 101. The invention 100 is configured for use with a dish washing machine 104. The dish washing machine 104 is a domestic appliance. The dish washing machine 104 is configured for use in cleaning crockery and cutlery after their use.

The invention 100 monitors the operation of the dish washing machine 104. The invention 100 determines and indicates when the contents of the dish washing machine 104 are clean. The monitoring module 102 is placed inside of the dish washing machine 104. The monitoring module 102 detects the presence of water in the dish washing machine 104 to determine whether the dish washing machine 104 has run. The announcement module 101 attaches to the door of the dish washing machine 104. The announcement module 101 visually and audibly indicates whether the contents of the dish washing machine 104 are clean and dirty.

The announcement module 101 is an electric device. The announcement module 101 mounts on the access door into the dish washing machine 104. The announcement module 101 monitors the cant of the door of the dish washing machine 104 relative to the force of gravity. The announcement module 101 provides visual and audible indications about the status of the contents of the dish washing machine 104. The announcement module 101 comprises a first housing 111 and a first control circuit 112.

The first housing 111 is a rigid structure. The first housing 111 contains the first control circuit 112. The first housing 111 is formed with all apertures and form factors necessary to allow the first housing 111 to accommodate the use, the operation, and the external connections of the first control circuit 112. Methods to form a first housing 111 suitable for the purposes described in this disclosure are well-known and documented in the mechanical arts. The first housing 111 mounts on the access door into the dish washing machine 104 such that the first housing 111 is visible from the exterior of the dish washing machine 104. The first housing 111 further comprises an adhesive 131. The adhesive 131 is a chemical substance that physically attaches the first housing 111 to the exterior surface of the door of the dish washing machine 104. The adhesive 131 is applied to an exterior face of the first housing 111.

The first control circuit 112 is an electric circuit. The first control circuit 112 controls the operation of the announcement module 101. The first control circuit 112 monitors the wireless communication link 103 to receive messages from the monitoring module 102. The first control circuit 112 monitors the cant of the door of the dish washing machine 104 relative to the force of gravity.

The first control circuit 112 generates a visual indication that the dish washing machine 104 needs to run when the exterior surface of the door of the dish washing machine 104 has been positioned at a cant of 90-degrees from the direction of the force of gravity for a period of greater than a previously determined period of time. The first control circuit 112 generates a visual indication that the dish washing machine 104 has been run when the first control circuit 112 receives a message from the monitoring module 102 over the wireless communication link 103 that water has been detected inside the dish washing machine 104. The first control circuit 112 generates an audible indication that the exterior surface of the door of the dish washing machine 104 has been positioned at a cant of 90-degrees from the direction of the force of gravity for a period of greater than a previously determined period of time.

The first control circuit 112 comprises a first logic module 151, a first communication module 152, a first battery 153, a plurality of LEDs 154, a tilt switch 155, and a speaker 156. The first logic module 151, the first communication module 152, the first battery 153, the plurality of LEDs 154, the tilt switch 155, and the speaker 156 are electrically interconnected.

The first logic module 151 is a readily and commercially available programmable electronic device that is used to manage, regulate, and operate the first control circuit 112. Depending on the specific design and the selected components, the first logic module 151 can be a separate component within the first control circuit 112 or the functions of the first logic module 151 can be incorporated into another component within the first control circuit 112. The first communication module 152 is a wireless electronic communication device that allows the first logic module 151 to wirelessly communicate with the second control circuit 122. Specifically, the first communication module 152 establishes the wireless communication link 103 between the first control circuit 112 and the second control circuit 122. In the first potential embodiment of the disclosure the first communication module 152 supports a communication protocol selected from the group consisting of a WiFi™ protocol or a Bluetooth™ protocol.

The first logic module 151 further comprises a timing device 171. The timing device 171 is an electrical circuit. The timing device 171 is a timing circuit that is provisioned with the first logic module 151. The timing device 171 measures the time that the exterior surface of the door of the dish washing machine 104 is perpendicular to the force of gravity such that the first logic module 151 can determine whether this time is greater than the previously determined period of time.

The first battery 153 is an electrochemical device. The first battery 153 converts chemical potential energy into the electrical energy used to power the first control circuit 112.

Each of the plurality of LEDs 154 is an electric circuit element. Each of the plurality of LEDs 154 is controlled by the first logic module 151. Each LED selected from the plurality of LEDs 154 illuminates when the first logic module 151 applies a voltage across the selected LED. Each of the plurality of LEDs 154 provides a visual indication regarding the operating status of the dish washing machine 104. The plurality of LEDs 154 further comprises a red LED 181, a green LED 182, a red LED 181 limit resistor 183, and a green LED 182 limit resistor 184.

The red LED 181 is an LED selected from the plurality of LEDs 154. The illumination of the red LED 181 has a red color. The first logic module 151 controls the operation of the red LED 181. The first logic module 151 illuminates the red LED 181 when the dish washing machine 104 needs to run. The green LED 182 is an LED selected from the plurality of LEDs 154. The illumination of the green LED 182 has a green color. The first logic module 151 controls the operation of the green LED 182. The first logic module 151 illuminates the green LED 182 when the dish washing machine 104 has been run.

The red LED 181 limit resistor 183 is an electric circuit element known as a limit resistor. The red LED 181 limit resistor 183 electrically connects in series with the red LED 181. The red LED 181 limit resistor 183 limits the flow of electricity through the red LED 181. The green LED 182 limit resistor 184 is an electric circuit element known as a limit resistor. The green LED 182 limit resistor 184 electrically connects in series with the green LED 182. The green LED 182 limit resistor 184 limits the flow of electricity through the green LED 182.

The tilt switch 155 is an electrical switch. The first logic module 151 monitors the actuation of the tilt switch 155. The tilt switch 155 is actuated by the angle formed by the cant between the exterior surface of the door of the dish washing machine 104 and the force of gravity. When the first logic module 151 detects through the tilt switch 155 that the door of the dish washing machine 104 is perpendicular to the force of gravity, the first logic module 151 illuminates the red LED 181 of the plurality of LEDs 154 to indicate that the dish washing machine 104 needs to run.

The speaker 156 is a transducer. The first logic module 151 controls the operation of the speaker 156. When the first logic module 151 detects through the tilt switch 155 that the door of the dish washing machine 104 is perpendicular to the force of gravity, the first logic module 151 generates an audible sound through the speaker 156 to indicate that the dish washing machine 104 needs to run.

The monitoring module 102 is an electric device. The monitoring module 102 is placed inside the dish washing machine 104. The monitoring module 102 detects when the dish washing machine 104 is operating by detecting the presence of water spraying within the dish washing machine 104. The monitoring module 102 forms the wireless communication link 103 with the announcement module 101.

The monitoring module 102 communicates a message to the announcement module 101 that the dish washing machine 104 is operating. The monitoring module 102 comprises a second housing 121 and a second control circuit 122.

The second housing 121 is a rigid structure. The second housing 121 contains the second control circuit 122. The second housing 121 is formed with all apertures and form factors necessary to allow the second housing 121 to accommodate the use, the operation, and the external connections of the second control circuit 122. Methods to form a second housing 121 suitable for the purposes described in this disclosure are well-known and documented in the mechanical arts. The second housing 121 hangs on a rack contained inside the dish washing machine 104. The second housing 121 is a fluid impermeable structure. The second housing 121 further comprises a hook 141 and a capture cup 142.

The hook 141 is a curved mechanical structure. The hook 141 attaches to the portion of the second housing 121 that contains the monitoring module 102. The hook 141 suspends the second housing 121 from a rack contained inside the dish washing machine 104. The capture cup 142 is a pan that is formed in the second housing 121. The capture cup 142 captures water that is spraying inside the dish washing machine 104.

The second control circuit 122 is an electric circuit. The second control circuit 122 controls the operation of the monitoring module 102. The second control circuit 122 monitors the space inside the dish washing machine 104 for indications of water. The second control circuit 122 transmits a message to the first control circuit 112 over the wireless communication link 103 indicating that water has been detected inside the dish washing machine 104. The second control circuit 122 comprises a second logic module 161, a second communication module 162, a second battery 163, and a conductive sensor 164. The second logic module 161, the second communication module 162, the second battery 163, and the conductive sensor 164 are electrically interconnected.

The second logic module 161 is a readily and commercially available programmable electronic device that is used to manage, regulate, and operate the second control circuit 122. Depending on the specific design and the selected components, the second logic module 161 can be a separate component within the second control circuit 122 or the functions of the second logic module 161 can be incorporated into another component within the second control circuit 122. The second communication module 162 is a wireless electronic communication device that allows the second logic module 161 to wirelessly communicate with the first control circuit 112. Specifically, the second communication module 162 establishes a wireless communication link 103 between the second control circuit 122 and the first control circuit 112. In the first potential embodiment of the disclosure the second communication module 162 supports a communication protocol selected from the group consisting of a WiFi™ protocol or a Bluetooth™ protocol.

The second battery 163 is an electrochemical device. The second battery 163 converts chemical potential energy into the electrical energy used to power the second control circuit 122.

The conductive sensor 164 is an electrical device. The conductive sensor 164 detects the presence of water spraying inside the dish washing machine 104. The second logic module 161 monitors the conductive sensor 164. The conductive sensor 164 mounts in the capture cup 142 such that the conductive sensor 164. When the second logic module 161 detects through the conductive sensor 164 that water has accumulated within the capture cup 142, the second logic module 161 transmits a message to the first control circuit 112 that indicates that the dish washing machine 104 has run. When the first logic module 151 receives the message indicating that the dish washing machine 104 has run, the first logic module 151 illuminates the green LED 182 selected from the plurality of LEDs 154. The conductive sensor 164 is defined elsewhere in this disclosure.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Angle: As used in this disclosure, an angle is a measure of a region between two intersecting lines or surfaces.

Battery: As used in this disclosure, a battery is a chemical device consisting of one or more cells, in which chemical energy is converted into electricity and used as a source of power. Batteries are commonly defined with a positive terminal and a negative terminal.

Bluetooth™: As used in this disclosure, Bluetooth™ is a standardized communication protocol that is used to wirelessly interconnect electronic devices.

Buzzer: As used in this disclosure, a buzzer is two lead electrical device that generates an audible sound when voltage is applied to the two leads.

Cant: As used in this disclosure, a cant is an angular deviation from one or more reference lines (or planes) such as a vertical line (or plane) or a horizontal line (or plane).

Communication Link: As used in this disclosure, a communication link refers to the structured exchange of data between two objects.

Conductive Sensor: As used in this disclosure, a conductive sensor is a sensor used to detect the presence of a conductive liquid such as water. The conductive sensor comprises two electric terminals that present an electric voltage across them. An electric current passes between the two electrodes when the conductive liquid simultaneously immerses the two electrodes. A conductive sensor can be used to detect when the conductive liquid reaches a previously determined level by the placement of one of the two electrodes at that level.

Control Circuit: As used in this disclosure, a control circuit is an electrical circuit that manages and regulates the behavior or operation of a device.

Crockery: As used in this disclosure, crockery is a general term that refers to plates, bowls, cups, and other vessels that are used in the serving of food and beverages. As used in this disclosure, the term crockery includes vessels such as the cups, glasses or bottles used for the consumption of beverages. As used in this disclosure, the term crockery excludes cutlery.

Cutlery: As used in this disclosure, cutlery refers to one or more hand tools used by humans for the consumption of food. Common items of cutlery include, but are not limited to forks, knives, or spoons.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Hang: As used in this disclosure, to hang an object is to suspend an object above a surface from above such that the inferior end of the object does not form a significant portion of the load path of the object.

Hook: As used in this disclosure, a hook is an object that is curved or bent at an angle such that items can be hung on or caught by the object.

Housing: As used in this disclosure, a housing is a rigid structure that encloses and protects one or more devices.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Pan: As used in this disclosure, a pan is a hollow and prism-shaped containment structure. The pan has a single open face. The open face of the pan is often, but not always, the superior face of the pan. The open face is a surface selected from the group consisting of: a) an end of the prism structure that forms the pan; and, b) a lateral face of the prism structure that forms the pan. A semi-enclosed pan refers to a pan wherein an end of prism structure of the pan and a portion of the lateral face of the pan is also open.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Resistance: As used in this disclosure, resistance refers to the opposition provided by an electrical circuit (or circuit element) to the electrical current created by a DC voltage is presented across the electrical circuit (or circuit element). The term impedance is often used when referring to an AC voltage is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Rigid Structure: As used in this disclosure, a rigid structure is a solid structure formed from an inelastic material that resists changes in shape. A rigid structure will permanently deform as it fails under a force.

Speaker: As used in this disclosure, a speaker is an electrical transducer that converts an electrical signal into an audible sound.

Suspend: As used in this disclosure, to suspend an object means to support an object such that the inferior end of the object does not form a significant portion of the load path of the object. Include inferior superior and load path.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tilt Switch: As used in this disclosure, a tilt switch is a switch that is actuated by the angle of the switch relative to a reference direction. In many applications, the reference direction will be the force of gravity. Common tilt switch technologies include, but are not limited to, mercury switches and metal ball tilt switches.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry. The "555" timing circuit is a well-known, documented, and commercially available timing circuit.

Timing Device: As used in this disclosure, a timing device is an automatic mechanism for activating or deactivating a device at a specific time or after a specific period of time. This disclosure assumes that the logic module is provisioned with a timing circuit that can be used as a timing device. A timing device that activates an audible alarm is often referred to as a timer.

Transducer: As used in this disclosure, a transducer is a device that converts a physical quantity, such as pressure or brightness into an electrical signal or a device that converts an electrical signal into a physical quantity.

WiFi: As used in this disclosure, WiFi refers to the physical implementation of a collection of wireless electronic communication standards commonly referred to as IEEE 802.11x.

Wireless: As used in this disclosure, wireless is an adjective that is used to describe a communication channel between two devices that does not require the use of physical cabling.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A dishwasher status indicator comprising an announcement module, a monitoring module, and a wireless communication link;

wherein the wireless communication link exchanges data between the monitoring module and the announcement module;

wherein the dishwasher status indicator is configured for use with a dish washing machine;

wherein the dish washing machine is configured for use in cleaning crockery and cutlery;

wherein the dishwasher status indicator monitors the operation of the dish washing machine;

wherein the monitoring module is placed inside of the dish washing machine;

wherein the monitoring module detects the presence of water in the dish washing machine to determine whether the dish washing machine has run;

wherein the announcement module attaches to the door of the dish washing machine;

wherein the announcement module comprises a first housing and a first control circuit;

wherein the first housing contains the first control circuit;

wherein the first control circuit is an electric circuit;

wherein the first control circuit controls the operation of the announcement module;

wherein the first control circuit monitors the wireless communication link to receive messages from the monitoring module;

wherein the first control circuit monitors the cant of the door of the dish washing machine relative to the force of gravity;

wherein the first control circuit generates a visual indication that the dish washing machine needs to run when the exterior surface of the door of the dish washing machine has been positioned at a cant of 90-degrees from the direction of the force of gravity for a period of greater than a previously determined period of time;

wherein the first control circuit generates a visual indication that the dish washing machine has been run when the first control circuit receives a message from the monitoring module over the wireless communication link that water has been detected inside the dish washing machine;

wherein the first control circuit generates an audible indication that the exterior surface of the door of the dish washing machine has been positioned at a cant of 90-degrees from the direction of the force of gravity for a period of greater than a previously determined period of time.

2. The dishwasher status indicator according to claim 1 wherein the announcement module is an electric device;

wherein the announcement module mounts on the door into the dish washing machine;

wherein the announcement module monitors the cant of the door of the dish washing machine relative to the force of gravity;

wherein the announcement module provides visual and audible indications about the status of the dish washing machine.

3. The dishwasher status indicator according to claim 2 wherein the monitoring module is an electric device;

wherein the monitoring module is placed inside the dish washing machine;

wherein the monitoring module detects when the dish washing machine is operating by detecting the presence of water spraying within the dish washing machine;

wherein the monitoring module forms the wireless communication link with the announcement module;

wherein the monitoring module communicates a message to the announcement module that the dish washing machine is operating.

4. The dishwasher status indicator according to claim 3 wherein the monitoring module comprises a second housing and a second control circuit;

wherein the second housing contains the second control circuit.

5. The dishwasher status indicator according to claim 4 wherein the first housing is a rigid structure;

wherein the first housing mounts on the door into the dish washing machine such that the first housing is visible from the exterior of the dish washing machine.

6. The dishwasher status indicator according to claim 5 wherein the second housing is a rigid structure;

wherein the second housing hangs on a rack contained inside the dish washing machine;

wherein the second housing is a fluid impermeable structure.

7. The dishwasher status indicator according to claim 6 wherein the second control circuit is an electric circuit;

wherein the second control circuit controls the operation of the monitoring module;

wherein the second control circuit monitors the space inside the dish washing machine for indications of water;

wherein the second control circuit transmits a message to the first control circuit over the wireless communication link indicating that water has been detected inside the dish washing machine.

8. The dishwasher status indicator according to claim 6 wherein the first control circuit comprises a first logic module, a first communication module, a first battery, a plurality of LEDs, a tilt switch, and a speaker;

wherein the first logic module, the first communication module, the first battery, the plurality of LEDs, the tilt switch, and the speaker are electrically interconnected.

9. The dishwasher status indicator according to claim 8 wherein the second control circuit comprises a second logic module, a second communication module, a second battery, and a conductive sensor;

wherein the second logic module, the second communication module, the second battery, and the conductive sensor are electrically interconnected.

10. The dishwasher status indicator according to claim 9 wherein the first housing further comprises an adhesive;

wherein the adhesive is a chemical substance that physically attaches the first housing to the exterior surface of the door of the dish washing machine;

wherein the adhesive is applied to an exterior face of the first housing.

11. The dishwasher status indicator according to claim 10
wherein the second housing further comprises a hook and a capture cup;
wherein the hook is a curved mechanical structure;
wherein the hook attaches to the portion of the second housing that contains the monitoring module;
wherein the hook suspends the second housing from a rack contained inside the dish washing machine;
wherein the capture cup is a pan that is formed in the second housing;
wherein the capture cup captures water from inside the dish washing machine.

12. The dishwasher status indicator according to claim 11
wherein the first logic module is a programmable electronic device;
wherein the first communication module is a wireless electronic communication device;
wherein the first communication module forms the wireless communication link between the first control circuit and the second control circuit.

13. The dishwasher status indicator according to claim 12
wherein the first battery is an electrochemical device;
wherein the first battery converts chemical potential energy into the electrical energy used to power the first control circuit;
wherein each of the plurality of LEDs is an electric circuit element;
wherein each of the plurality of LEDs is controlled by the first logic module;
wherein each LED selected from the plurality of LEDs illuminates when the first logic module applies a voltage across the selected LED;
wherein each of the plurality of LEDs provides a visual indication regarding the operating status of the dish washing machine.

14. The dishwasher status indicator according to claim 13
wherein the tilt switch is an electrical switch;
wherein the first logic module monitors the actuation of the tilt switch;
wherein the tilt switch is actuated by the angle formed by the cant between the exterior surface of the door of the dish washing machine and the force of gravity;
wherein the speaker is a transducer;
wherein the first logic module controls the operation of the speaker;
wherein when the first logic module detects through the tilt switch that the door of the dish washing machine is perpendicular to the force of gravity, the first logic module generates an audible sound through the speaker to indicate that the dish washing machine needs to run.

15. The dishwasher status indicator according to claim 14
wherein the second logic module is a programmable electronic device;
wherein specifically, the second communication module forms the wireless communication link between the second control circuit and the first control circuit;
wherein the second battery is an electrochemical device;
wherein the second battery converts chemical potential energy into the electrical energy used to power the second control circuit.

16. The dishwasher status indicator according to claim 15
wherein the conductive sensor is an electrical device;
wherein the conductive sensor detects the presence of water spraying inside the dish washing machine;
wherein the second logic module monitors the conductive sensor;
wherein the conductive sensor mounts in the capture cup such that the conductive sensor;
wherein when the second logic module detects through the conductive sensor that water has accumulated within the capture cup, the second logic module transmits a message to the first control circuit that indicates that the dish washing machine has run.

17. The dishwasher status indicator according to claim 16
wherein the plurality of LEDs further comprises a red LED, a green LED, a red LED limit resistor, and a green LED limit resistor;
wherein the red LED is an LED selected from the plurality of LEDs;
wherein the illumination of the red LED has a red color;
wherein the first logic module controls the operation of the red LED;
wherein the first logic module illuminates the red LED when the dish washing machine needs to run;
wherein the green LED is an LED selected from the plurality of LEDs;
wherein the illumination of the green LED has a green color;
wherein the first logic module controls the operation of the green LED;
wherein the first logic module illuminates the green LED when the dish washing machine has been run;
wherein the red LED limit resistor is an electric circuit element known as a limit resistor;
wherein the red LED limit resistor electrically connects in series with the red LED;
wherein the red LED limit resistor limits the flow of electricity through the red LED;
wherein the green LED limit resistor is an electric circuit element known as a limit resistor;
wherein the green LED limit resistor electrically connects in series with the green LED;
wherein the green LED limit resistor limits the flow of electricity through the green LED;
wherein when the first logic module detects through the tilt switch that the door of the dish washing machine is perpendicular to the force of gravity, the first logic module illuminates the red LED of the plurality of LEDs to indicate that the dish washing machine needs to run;
wherein when the first logic module receives the message indicating that the dish washing machine has run, the first logic module illuminates the green LED selected from the plurality of LEDs.

* * * * *